US005743964A

United States Patent [19]

Pankake

[11] Patent Number: 5,743,964

[45] Date of Patent: Apr. 28, 1998

[54] ROLL COATING SYSTEM

[75] Inventor: Eugene A. Pankake, Newburgh, Ind.

[73] Assignee: FATA Hunter, Inc., Riverside, Calif.

[21] Appl. No.: 378,305

[22] Filed: Jan. 24, 1995

[51] Int. Cl.[6] ..... B05C 1/00

[52] U.S. Cl. ..... 118/712; 118/216; 118/222; 118/249; 118/255; 118/256; 118/262

[58] Field of Search ..... 118/712, 216, 118/222, 249, 255, 256, 262; 427/428; 101/351, 352, 247

[56] References Cited

U.S. PATENT DOCUMENTS

| | | | |
|---|---|---|---|
| Re. 31,695 | 10/1984 | Zink | 427/211 |
| 3,019,336 | 1/1962 | Johns | 427/9 |
| 3,397,675 | 8/1968 | De Ligt | 118/258 |
| 3,425,861 | 2/1969 | Jones | 427/9 |
| 3,530,823 | 9/1970 | Giordano | 118/707 |
| 3,916,824 | 11/1975 | Knodel et al. | 118/262 |
| 3,989,937 | 11/1976 | Fay et al. . | |
| 4,046,931 | 9/1977 | Innes et al. | 427/428 |
| 4,155,637 | 5/1979 | Witte et al. . | |
| 4,177,304 | 12/1979 | Berry | 427/434.3 |
| 4,182,259 | 1/1980 | Garner et al. | 118/712 |
| 4,246,301 | 1/1981 | Alheid et al. | 427/348 |
| 4,251,566 | 2/1981 | Gingerich | 427/10 |
| 4,282,275 | 8/1981 | Werner | 427/428 |
| 4,313,982 | 2/1982 | Miura | 427/428 |
| 4,338,881 | 7/1982 | Tokuno | 118/673 |
| 4,354,449 | 10/1982 | Zink | 118/126 |
| 4,360,538 | 11/1982 | Craemer et al. | 427/8 |
| 4,402,232 | 9/1983 | Stegmuller et al. . | |
| 4,485,132 | 11/1984 | Furuzono et al. | 427/428 |
| 4,503,802 | 3/1985 | Keller et al. | 118/249 |
| 4,569,306 | 2/1986 | Ito et al. | 118/249 |
| 4,569,864 | 2/1986 | McIntyre | 427/428 |
| 4,704,296 | 11/1987 | Leanna et al. | 427/9 |
| 4,852,515 | 8/1989 | Terasaka et al. | 118/262 |
| 4,945,772 | 8/1990 | Shepard et al. . | |
| 4,957,770 | 9/1990 | Howarth | 427/9 |
| 5,081,951 | 1/1992 | Most et al. | 118/126 |
| 5,125,339 | 6/1992 | Rogge . | |
| 5,162,131 | 11/1992 | Rantanen et al. | 427/10 |
| 5,275,656 | 1/1994 | Jendroska | 118/46 |
| 5,302,203 | 4/1994 | Zimmer | 118/117 |
| 5,303,670 | 4/1994 | Rantanen | 118/228 |
| 5,310,573 | 5/1994 | Tanokuchi et al. | 427/9 |
| 5,340,611 | 8/1994 | Kustermann et al. | 427/361 |
| 5,413,806 | 5/1995 | Braun | 118/712 |

FOREIGN PATENT DOCUMENTS

| | | |
|---|---|---|
| 0 480 897 A1 | 4/1992 | European Pat. Off. . |
| 4066155 | 2/1992 | Japan . |

*Primary Examiner*—Laura Edwards

*Attorney, Agent, or Firm*—Knobbe, Martens, Olson & Bear, LLP

[57] ABSTRACT

A roll coating system for coating strip metal having a plurality of coating head rolls mounted on support sleds capable of linear translation along a single rail. Precision linear actuators are located between each support sled and between one of the sleds and a fourth sled. A splice traverse mechanism actuated by a piston/cylinder displaces the fourth sled. Each of the rolls can be independently displaced or the entire head can be displaced by the splice traverse mechanism. Force measurement sensors are located in the support sleds for an accurate measurement of nip pressures between the respective rolls. The elastic response of the support sleds may be varied to alter the natural resonant frequency of the coating system. The movement of a pan lift mechanism is coupled to the movement of the pickup roll so as to eliminate the chance for collision therebetween. The movement of a lift roll in a double coating environment, or the movement of a pass line roll in a U-wrap environment may be coupled with the movement of the roll coating head.

34 Claims, 10 Drawing Sheets

20
30
30a
40a
34
34a
40b
36
36a
40c
38
42c
44
47
2
2
61
39
46
60
62
64
66
68
58
76
74
72
70
42b
42a
24
22
26
37
32
28
28a
39
29
x
y 342
346
344
348

320
326
328
330
332
334
336
338
340
322
324

ROLL COATING SYSTEM

FIELD OF THE INVENTION

The present invention relates to the application of coatings to the surface of sheet metal and, more particularly, to an improved roll coating system and method.

BACKGROUND OF THE INVENTION

There are numerous well-known techniques for applying a coating of paint or lacquer to a metal strip. For example, a coating of such material can be applied to a continuous web of metal strip with a roll coater. The roll coater includes an applicator roll having a deformable elastic cover made of polyurethane or a hard synthetic rubber, and a relatively hard, usually steel, metering roll which picks up coating medium from a reservoir. The metering roll presses against the deformable cover of the applicator roll to control the thickness of the film of coating medium on the applicator roll being transferred to the moving metal strip. A support or backup roll supports the opposite side of the portion of the strip in contact with the applicator roll. In some instances, the magnitude of the force between the applicator roll and backup roll necessitates the use of an intermediate roll between the applicator roll and the metering roll. An intermediate roll may also be used to improve appearance of the coating system. Such a two or three roll assembly comprised of at least an applicator roll and a metering roll is termed a coating head. Although the rolls of the coating head can be arranged with respect to a backup roll in a variety of configurations, it is particularly advantageous to align the axes of the coating head rolls along a line passing through the axis of the backup roll. Another popular coating layout is a three-roll V configuration, with the intermediate roll out of alignment and above the axes of the other two rolls.

The quantity of liquid passing between the metering roll and the applicator roll is dependent both on the contact force between the rolls (the "nip pressure") and the viscous characteristics of the coating medium. That is, the quantity of liquid passing between the rolls is dependent on the magnitude of the force with which the hard steel metering roll bites into the deformable cover of the applicator roll and the viscosity of the liquid coating the rotating rolls which prevents the liquid from being completely squeezed from between the rotating rolls.

FIG. 11 schematically illustrates a conventional coating system 320 utilizing a plurality of rollers for applying paint or other coating to a strip 322, typically metal. The strip passes between a large backup roll 324 and an applicator roll 326. The applicator roll 326 is one of three rolls of the coating head. The axes of the three rolls are parallel and may be contained within a single inclined plane. A second coating head roll 328 is positioned intermediate the first applicator roll 326 and a third roll 330. The third coating head roll 330 picks up paint from within a pan 332 and delivers it to the second roll 328, which in turn delivers the paint to the applicator roll 326. All of the rolls are rotated about their respective axes by means not shown. The relative position and pressure between the respective rolls, as well as the viscous characteristics of the paint, determines the amount of paint which is applied to the strip 322.

The magnitude of the pressure between the rolls is controlled by moving the rolls relative one another along a line perpendicular to and intersecting each of their axes. This movement is facilitated by a plurality of stacked linear slides mounted on linear bearings (not shown) on each longitudinal end of the rolls. A lower linear slide 334, rigidly mounted to the journal bearing bracket for the first applicator roll 326, is provided with linear bearings adapted to slide on a rail mounted to a frame 336. The rail is spaced downward from and is parallel to the line which is perpendicular to and intersects the axes of each of the rollers. A middle linear slide 338, mounted to the journal bearing bracket of the second applicator roll 328, is adapted to slide relative to a rail mounted on the lower linear slide 334 with the use of linear bearings. Finally, an upper linear slide 340, mounted to the journal bearing bracket for the third applicator roll 330, is provided with linear bearings adapted to slide on a rail mounted to the middle linear slide 338. The rails on which the bearings slide are not shown, but are typically precision machined rectangular cross-section rods. In older systems, stacked dove-tail slides with two load bearing surfaces were used without linear bearings. The entire frame 336 carrying all three applicator rolls may be displaced along the same line by a mechanism not illustrated.

With this arrangement all three of the rolls together, or any one roll individually, can be displaced. The linear slides are constructed with an elongated portion parallel to the rails, and a leg extending perpendicularly to the elongated portion on the end farthest from the backup roll. Linear actuators such as hand wheels or small stepper motors turning lead screws within internally threaded nuts are positioned between the respective perpendicular legs of each of the linear slides to provide relative movement therebetween.

FIG. 11*a* schematically illustrates one version of a mechanism for displacing the respective linear slides. A stepper motor 342 turns a threaded rod 344 which displaces an internally threaded nut 346. The nut 346 is rigidly coupled to the respective slide through a force measurement sensor 348. In this manner, the amount of pressure between the respective rolls can be measured by measuring the force between two slides, or between the first slide 334 and the frame 336. The coating head rolls are typically aligned at an angle with the horizontal with the applicator roll being at the highest elevation and the metering roll being at the lowest elevation. The linear actuators positioned between the perpendicular legs of each linear slide push the slides uphill along the respective rail.

There are several limitations to such conventional coating systems. Specifically, the large structure and number of linear bearings needed between the stacked linear slides and frame increases the cost of the system. The large mass of the linear slides also contributes to a reduction in efficiency of displacement. In particular, the linkage mechanisms between the linear slides experience a certain amount of strain as the slides are accelerating and decelerating, reducing the efficient usage of the linear actuators. Additionally, the amount of force required to move the large slides and rolls is significant, requiring relatively high torque stepper motors. Because the paint used is flammable, the stepper motors must be specially rated for use in explosive environments so as not to spark. These factors drive up the cost of the motors.

Importantly, while the force between the rolls is a critical process variable, a variety of factors made it difficult to accurately measure this force. For example, it is necessary to compensate for the static resistance to rolling of each linear slide. For example, each linear bearing utilized by the slide will have a static resistance to rolling of approximately 5 to 7 pounds. In addition, as the respective slides and their supporting bearings corrode or become contaminated with coatings, the amount of force required to displace the slides increases. Since the amount of increased force required varies with the amount of corrosion or contamination, it is particularly difficult to compensate for this variable.

As discussed above, another important process variable which affects the quality of the resulting coating strip is the viscosity of the coating medium. Typical coating mediums include a percent solid portion and a solvent. There are large ranges of percent solids and types of solvents used, but all experience viscosity changes over time as the solvent component evaporates. Since the coating medium is loaded into a trough or coating pan in which the pickup roll is immersed, the large surface area of exposed coating medium accelerates this evaporation process. As this viscosity change can occur within a relatively short time, it is thus important to measure the viscosity of the coating medium at regular intervals and adjust other process variables accordingly.

Another process variable is introduced by the softening and expansion of the polyurethane cover of applicator roll due to exposure to solvents in the coating medium. This distinct hardness change affects the amount of coating medium transferred between the applicator roll and the strip, or between the applicator roll and the adjacent intermediate roll. Most conventional coating machines do not monitor this hardness change, and are thus subject to great error. U.S. Pat. No. 5,310,573, issued to Tanokuchi, et al., discloses a method of controlling the thickness of coated film on a web through the use of a roll coater which measures the elasticity between two rolls by combining the nip pressure with the distance between the axes of the two rolls, and calculating the elasticity therefrom. Disadvantageously, as mentioned above, various factors make it extremely difficult to measure nip pressures accurately.

Some devices automatically adjust the coating process based on measurements taken of the film thickness of the applied film. In this method, the strip is first cured and an infrared or optical device is utilized to measure the film thickness, which is fed back into the coating process. In most conventional devices, however, an operator receives the measured data of the coated strip and guesses how to adjust the various parameters affecting the amount of coating medium applied to the strip. At present, the operator's intuition on the way the coating looks, and the particular quality of that coating run are utilized to make any adjustments. This is basically an art form. Even the most experienced operator occasionally makes a poor decision given the indirect method of monitoring coating quality. Furthermore, this manual adjustment method does not lend itself to repeatability and predictability.

Due to these and other limitations, there is a need for an improved method and apparatus for controlling the numerous process variables which effect quality of the coated strip in a coating machine.

SUMMARY OF THE INVENTION

The present invention provides an apparatus for applying a layer of controlled thickness onto the surface of a traveling web at an application location. The apparatus comprises a frame, a rail supported by the frame, and first and second roll sleds movable along and directly supported by the rail. A first roll is supported by the first roll sled and is journaled so as to be rotatable about a first axis. A second roll is supported by the second roll sled and is journaled to be rotatable about a second axis. The apparatus further includes a first motor coupled to the second roll sled to alter the relative distance between the first axis and the second axis. Preferably, the first motor is mounted on either the first roll sled or the second roll sled. The apparatus further comprises a second motor coupled to the first sled which alters the relative distance between the first axis and the application location. The first motor and second motor are each mounted on a different one of the sleds.

The apparatus may further comprise a coating pan supported by the frame for supplying liquid coating for application on the traveling web, a third roll sled movable along and directly supported by the rail, and a third roll supported by the third roll sled journaled so as to be rotatable about a third axis. A third motor may be coupled to the second roll sled to alter the relative distance between the second and third axes. Preferably, the third motor is mounted on the third roll sled.

In one particular embodiment, the apparatus comprises a second rail supported by the frame and a traverse sled movable along and directly supported the second rail. Additionally, the first rail is supported by the transverse sled. An actuator is connected to the transverse sled by a linkage which moves the traverse sled at a first speed when one of the rolls is in proximity to the application location, and at a second, faster speed when the roll is farther from the application location.

In another preferred embodiment of the present invention, an apparatus for applying a layer of liquid coating of controlled thickness onto the surface of a traveling web is provided. The apparatus comprises a frame, first and second roll sleds movable with respect to the frame along a line, and first and second rolls defining first and second axes, respectively. The first roll is supported by the first roll sled and journaled so as to be rotatable about the first axis, whereas the second roll is supported by the second roll sled and journaled so as to be rotatable about the second axes.

In a further aspect of the present invention, a liquid coating application apparatus comprises a frame, a first roll sled movable with respect to the frame, a first roll defining a first axis and supported by the first roll sled, a second roll sled movable with respect to the frame, and a second roll defining a second axis and supported by the second roll sled. Both the first and second rolls define first and second ends. The first and second rolls are journaled so as to be rotatable about the first and second axes, respectively. The apparatus includes a first motor mounted on the first roll sled at one of either the first end or the second end of the first roll, the first motor being coupled to the second roll sled to alter the relative distance between the first and second axes.

In accordance with a further aspect of the present invention, an apparatus for applying a controlled thickness of liquid coating onto the surface of the traveling web comprises a frame, a first roll sled movable in a direction with respect to the frame, a first roll having a first end and a second end and defining a first axis perpendicular to the direction the first roll sled moves, a second roll sled movable in the direction of movement of the first roll sled, and a second roll defining a first and second end and having a second axis perpendicular to the direction of movement of the first and second roll sleds. The first roll is supported and journaled for rotation about the first axis, while the second roll is journaled for rotation about the second axis. The first roll has a diameter one of larger than the dimension of the first roll sled in the direction of movement of the first roll sled and roughly as large as the average dimension of the first roll sled in the direction of movement (i.e. the first roll diameter is either greater than or equal to the dimension of the first roll sled in the direction of movement). The second roll has a diameter one of larger than the dimension of the second roll sled in the direction of movement and roughly as large as the diameter of the second roll sled in the direction of movement (i.e. the second roll diameter is either greater than or equal to the dimension of the second roll sled in the direction of movement). In another configuration, the dimension of either the first or second roll sled in the direction of movement is no greater than the average of the diameters of the first and second rolls.

In accordance with a further aspect of the present invention, an apparatus for applying a controlled thickness of liquid coating onto a front and back surface of a traveling web is provided. The apparatus comprises a frame, a first coating head for applying a layer of liquid coating of controlled thickness onto a front surface of the traveling web, and a second coating head for applying a layer of liquid coating of controlled thickness onto a back surface of the traveling web. Both the first and second coating heads comprise a first roll sled movable with respect to the frame, a first roll having a first end and a second end. The first roll defining a first axis supported by the first roll sled and journaled so as to be rotatable about the first axis. Each coating head includes a second roll sled movable with respect to the frame, and a second roll defining a first end and a second end. The second roll defines a second axis supported by the second roll sled and is journaled so as to be rotatable about the second axis. The apparatus further includes a traverse sled movable along the frame and connected to the first and second sleds of one of the coating heads such that movement of the traverse sled with respect to the frame causes movement of the first and second sleds with respect to the frame. The apparatus also includes a backup roll positioned between the first and second coating heads. A splice bypass device includes a bypass roll positioned between the second coating head and the backup roll. A linkage connected to the bypass roll and to the traverse sled selectively moves the bypass roll and the first coating head from an application position to a bypass position.

In accordance with a still further embodiment of the present invention, an apparatus for applying a controlled thickness of liquid coating onto a traveling web comprises a frame, a first roll sled movable with respect to the frame, a first roll having a first end and a second end, a second roll sled movable with respect to the frame, and a second roll defining a first end and a second end. The first roll defines a first axis supported by the first roll sled and is journaled so as to be rotatable about the first axis. The second roll defines a second axis supported by the second roll sled and is journaled so as to be rotatable about the second axis. The apparatus further includes a coating pan mounted on the second roll sled.

In accordance with another aspect of the invention, an apparatus for applying a layer of liquid coating of controlled thickness onto a traveling web is provided comprising: a frame, a first coating head, a backup roll supported by the frame, a second coating head positioned opposite the first coating head from the backup roll, a backup roll scraper positioned between the first coating head and the second coating head, a traverse sled movable with respect to the frame, and a backup roll bypass device. Both the first and second coating heads include a first roll sled movable with respect to the frame, the first roll journaled to be rotatable about a first axis and supported by the first roll sled, a second roll sled movable with respect to the frame, and a second roll journaled to be rotatable about a second axis and supported by the second roll sled. Both the first and second rolls have first and second ends. The traverse sled is connected to the first sled and second sled of the first coating head such that movement of the traverse sled with respect to the frame causes movement of both the first sled and the second sled of the first coating head with respect to the frame. The backup roll bypass device includes a bypass roll, and a linkage connected to the bypass roll and to the traverse sled for selectively moving the bypass roll and the first coating head from a first position to a second position. In the first position, the bypass roll is in a backup roll contact position (i.e. the web is in contact with the backup roll), and the first coating head is in an application location. In the second position, the bypass roll is in a backup roll bypass position (i.e. the web is out of contact with the backup roll) and the first coating head is spaced from the application location.

DESCRIPTION OF THE PREFERRED EMBODIMENTS

Although the present invention is described in terms of coating metal sheet with paint or other solvent-based coating medium, certain aspects of the present invention are applicable to other types of roll-coating environments, such as pretreaters, chemical coaters, etc.

Single Slide Coating Apparatus

Figure 1:
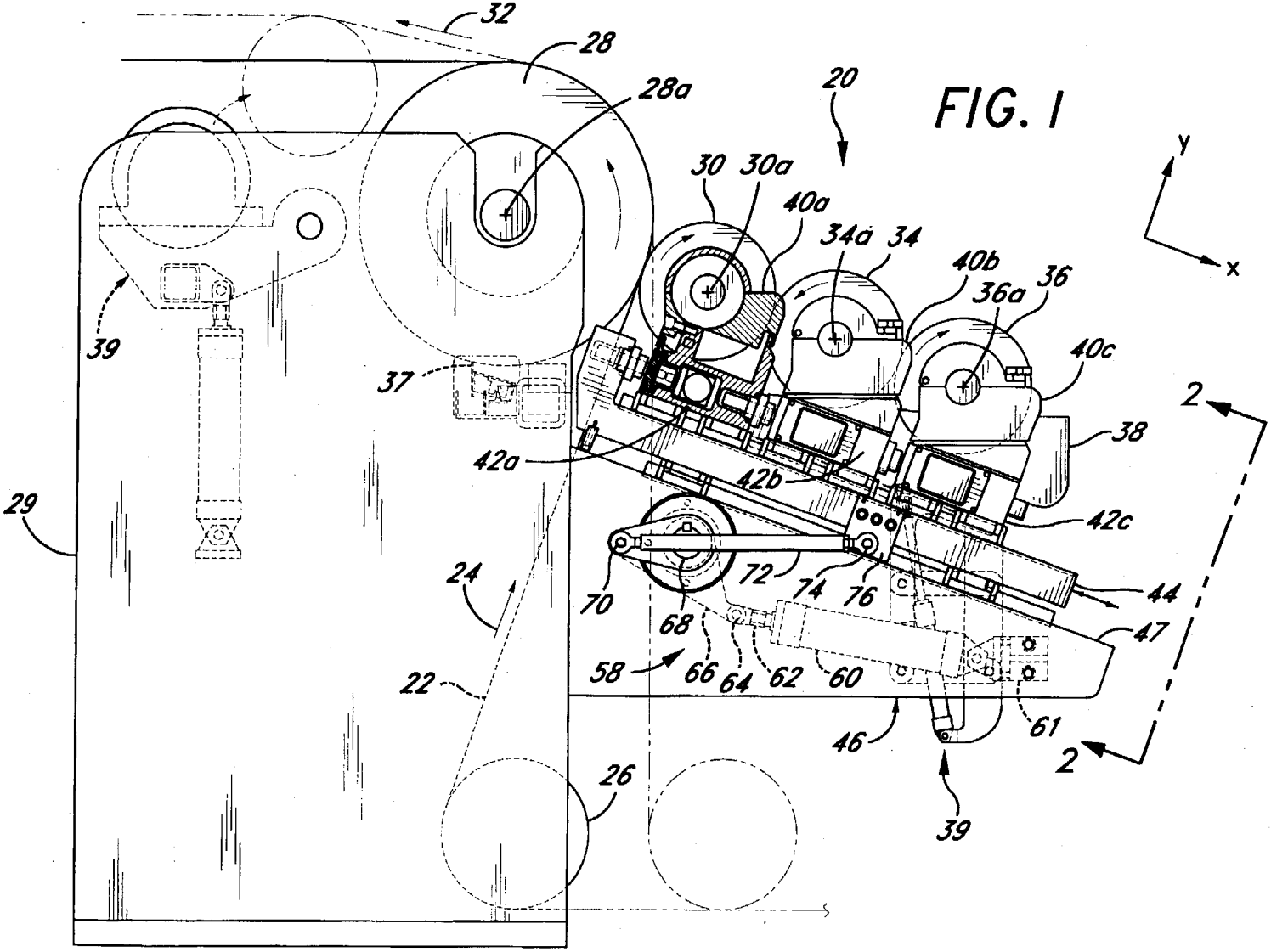
FIG. 1 is a side elevational view of a portion of a coating machine of the present invention incorporating a single linear slide having a rail on which three coating head rolls are slidably mounted.

FIG. 1 illustrates an apparatus 20 for coating one side of a strip of metal 22. The strip 22 travels around a guide roll 26 and upward in the direction of arrow 24 between a large backup roll 28 and a smaller applicator roll 30. The strip continues to the left in the direction of arrow 32 to a second coating apparatus (not shown) which coats the opposite side of the strip. It will be noted that although the embodiment of FIG. 1 includes a strip passing between an applicator roll and a backup roll, the inventive concept of the present invention can be utilized by coating apparatuses without a backup roll.

The apparatus 20 comprises several major components: the main frame 29 rotationally supporting the backup roll 28; a coating head including the applicator roll 30 at an upper end; a pair of dual subframes 46 on which the coating head traverses along angled upper surfaces 47; a traverse mechanism 58 mounted to one of the subframes 46 and adapted to translate the coating head; and a coating pan lift mechanism 39 mounted to a portion of the coating head and also to a coating pan 38. The various components of the apparatus 20 will be described separately below.

The coating apparatus 20 of FIG. 1 includes three rolls positioned in series with their respective axes extending coplanar and parallel to one another and aligned so that a line perpendicular to and intersecting each of the axes will also intersect the axis 28*a* of the backup roll 28. For the purpose of the present discussion, an orthogonal coordinate frame of reference is shown in FIG. 1 wherein the X-axis is parallel to the line which passes through the roll axes. The applicator roll 30 adjacent the backup roll 28 contacts an intermediate roll 34 which, in turn, contacts a metering or pickup roll 36. The three rolls 30, 34 and 36, the coating pan 38, and the backup roll 28 are supported by, and journaled for rotation with respect to a main frame 29. In this respect, the coating rolls 30, 34 and 36 extend along the Z-axis and are rotatably supported about their respective axes 30*a*, 34*a* and 36*a* at either end by support slides, described below. It should be noted that only one side of the apparatus is shown and thus only one of the dual subframes 46 under one end of the rolls is illustrated, the other being substantially identical for supporting the opposite end of the rolls.

The pickup roll 36 is partially submerged within a coating medium (not shown) in the coating pan 38. The pickup roll 36 lifts coating medium from the pan 38 and transfers it to the intermediate roll 34, which in turn transfers the coating medium to the applicator roll 30. The coating medium is then applied to the moving strip 22 by the applicator roll 30. Some excess coating medium may be transferred around the edges of the strip to the backup roll 28. Typically a doctor blade 37, comprising a narrow, elongated knife, mounts underneath the backup roll 28 and is biased toward the roll to scrape this excess coating medium therefrom. The lift mechanism 39 is provided underneath the rolls 30, 34 and 36 and between the dual subframes 46 for raising and lowering the coating pan 38, as will be more fully described below with reference to FIG. 5.

Typically, the intermediate roll 34 and pickup roll 36 are relatively rigid, and may be manufactured of steel. On the other hand, while the applicator roll 30 has a rigid inner core which may be manufactured of steel, it is covered with a deformable sleeve manufactured from a material such as polyurethane. Various sized rolls may be used, but in the disclosed embodiment, the rolls of the coating head 30, 34, and 36 are approximately 11 inches in diameter, while the backup roll 28 is approximately 24 inches in diameter.

Coating Head

The coating head comprising the three rolls 30, 34 and 36 will now be described in detail with reference to FIGS. 1–4. As stated previously, the axes 30*a*, 34*a*, 36*a* of the three rolls 30, 34 and 36 are aligned in series. Each roll is journaled for rotation about an opposed pair of mounting brackets 40. The mounting brackets are spaced apart and located proximate each longitudinal end of the rolls. The rolls are thus suspended between the mounting brackets 40 over a space in which the coating pan 38 and lift mechanism 39 are disposed. For sake of simplicity, only one side of the apparatus 20 is shown in FIG. 1. It will be understood that a similar arrangement is provided on the opposite side of the rolls. Furthermore, the mounting brackets 40 provide simple bearings for the roll necks 56, while the opposite end of each roll is driven by a motor and gear assembly (not shown) as is well known by those of skill in the art.

The applicator roll 30 is journaled for rotation about a pair of mounting brackets 40*a*, the intermediate roll 34 is journaled for rotation about a second pair of mounting brackets 40*b*, and the pickup roll 36 is journaled for rotation about a pair of mounting brackets 40*c*. Each of the mounting brackets 40*a,b,c* forms a portion of a support sled 42*a,b,c*. In particular, sleds 42*a*, 42*b* and 42*c* support the mounting brackets 40 of the rolls 30, 34 and 36, respectively. Each of the support sleds 42*a,b,c* is slidably mounted over a large L-shaped traverse sled 44. The traverse sled 44, in turn, is slidably mounted with respect to the stationary subframe 46 of the apparatus 20. The subframe 46 includes the upper sloped surface 47 along which the coating head is slidably mounted.

The support sleds 42*a,b,c* include at least one linear bearing 48 adapted to slide with minimum of friction over a first rail 50. Preferably, as in the disclosed embodiment, each side of each support sled includes two linear bearings. The first rail 50 comprises a precision machined rectangular rod fixedly attached to the traverse sled 44. The traverse sled 44 includes a plurality of linear bearings 52 which travel over a second rail 54 mounted on the subframe 46. Both the first rail 50 and the second rail 54 are aligned in parallel and underneath the terminal end of the roll necks 56 of each of the rolls 30, 34 and 36.

To support the great weight of the rolls in such a small area, the linear bearings 48 and 52 preferably include cylindrical rollers positioned to contact the rails 50 and 54 along their lengths. More specifically, each support sled 42*a,b,c* has a length parallel to the rail 50 generally corresponding to the respective roll diameter. However, in coating systems with differing roll diameters, the length of the support sleds 42*a,b,c* in the direction of movement along the rail 50, the maximum length of any one sled is approximately equal to the average roll diameter. For example, a 14 inch roll may be installed in conjunction with two 7 inch rolls, and the maximum length of each of the sleds 40*a,b,c* is approximately 9.33 inches. The roll diameters range from about 7 inches to about 14 inches. As each support sled 42*a,b,c* includes two linear bearing 48, the rollers within the bearings must be correspondingly small, and thus must be capable of withstanding large Hertz contact stresses. A particularly suitable example of bearing is one of several linear carriage bearings manufactured by Schneeberger Linear Technology of Massachusetts.

Reduced Roll Support Sled Mass

A major advantage of the present apparatus 20 is the elimination of massive linear slides for each roll. The support sleds 42*a,b,c* of the present apparatus 20 take up only a fraction of the space below each roll. A major cost savings is realized by the reduction in large precision machined components. In a preferred embodiment, the support sleds 42*a,b,c* weigh approximately 50 lbs. Previously, the large L-shaped slides ranged from 120 lbs to between 6–700 lbs for the longest beneath the applicator roll.

Another benefit realized by reducing the mass of the roll support sleds is the increased adjustability of the spring response of the system. More particularly, as with any mechanical system, vibrations may set up harmonic oscillations which coincide with the natural frequency of the system. If one of the rolls or roll necks is out of round, or as a result of hydrodynamic vibrations, the resulting oscillations can match the natural frequency and damage the machine. Prior attempts to alleviate this problem have concentrated on increasing the mass and rigidity of the roll supports under the assumption this would limit the vibration. However, it has been found that a more effective approach is to control the relative stiffness of the system by reducing its mass and rigidity. With a knowledge of the possible harmonics resulting from unbalanced components, one can compensate by constructing the system to have a mass and stiffness with an out-of phase natural frequency. The flexibility of the pedestal 100, may be adjusted to suit various systems and operating regimens. Key is the ability to customize the flexibility in relation to the various static and dynamic factors to avoid vibration within the pedestal 100 which excites the natural frequency.

Figure 4:
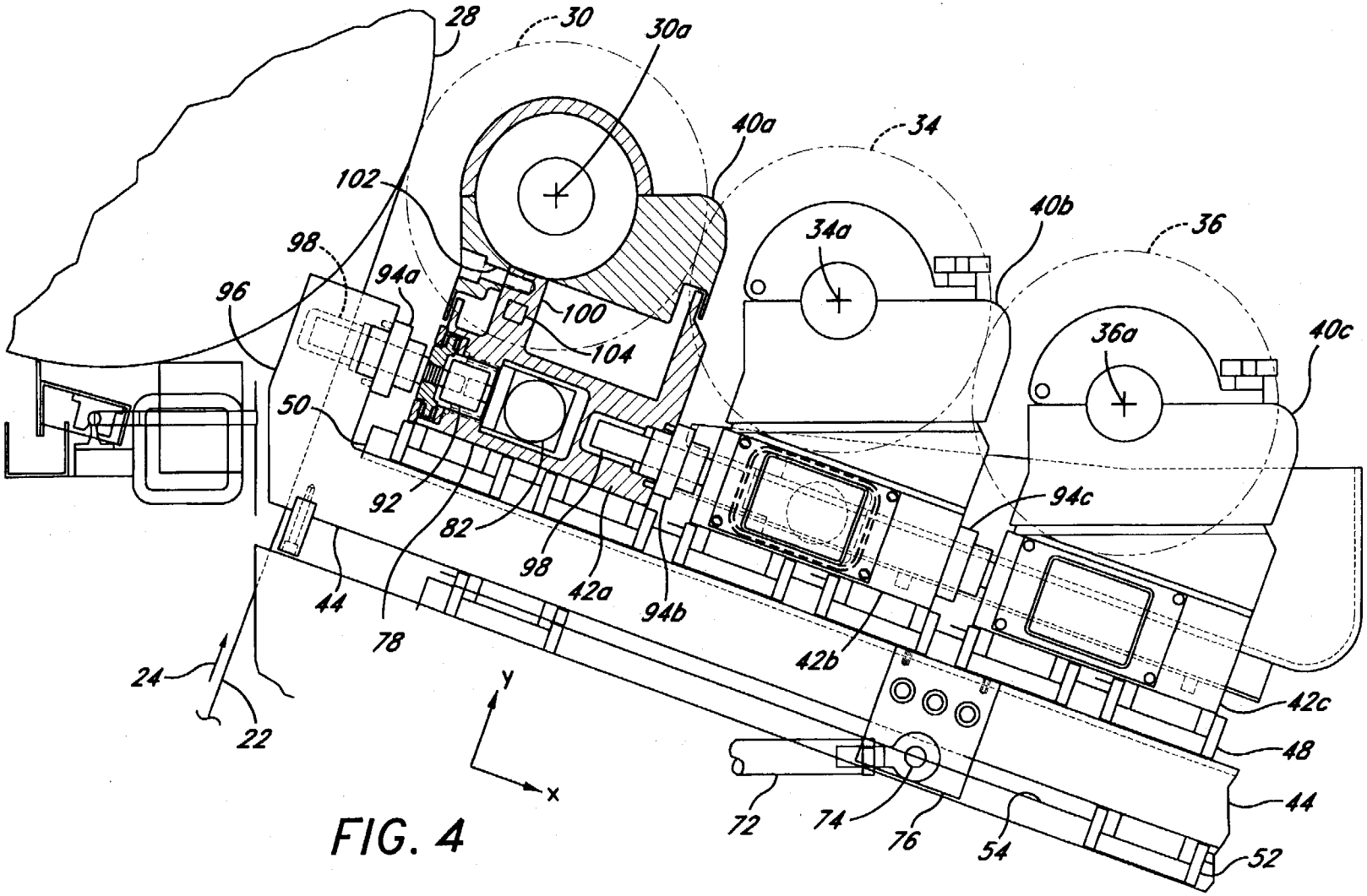
FIG. 4 is an enlarged vertical cross-sectional view of a support slide shown in FIG. 1.

A load bearing portion of the support sleds 42*a,b,c* is shown in FIG. 4 as pedestal 100. The relatively small cross-section of upstanding roll pedestals 100 permits the system stiffness to be adjusted relatively easily. Specifically, given the great weight of the rolls and potential vibratory amplitude from out of round rolls, the small cross-section of the roll pedestals 100 provides a relatively flexible response. Because of this relative flexibility, modifying the stiffness of the roll pedestals 100 by just a little produces a noticeable change in the natural frequency of the system. As opposed to prior extremely rigid supports, the roll pedestal 100 may be as small as 1 inch square in cross-sectional area, and is desirably less than 2 square inches in area. While the preferred cross-sectional area will vary depending on the shape of the pedestal, to ensure sufficient flexibility it is preferable that the maximum cross-sectional area of the pedestal be approximately 4 inches.

Although these are preferred cross-sectional areas, larger cross-sections are possible while still retaining control over the system stiffness. In general, the size of the pedestals 100 is dependant primarily on the weight of the roll supported, the maximum lateral interroll force expected, the height of the pedestal, and the cross-sectional shape of the pedestal. The cross-section of each roll pedestal 100 is preferably rectangular, but may also be rounded or other shapes. The specific shape of the pedestal 100 may be determined by a finite element analysis of stresses induced in several shapes chosen for their suitability for placing strain gauges. This will be discussed in more detail below with respect to force measurement between the rolls.

Moreover, the roll pedestal 100 may be manufactured as a separate component which can be replaced for varying the spring response of the system. This is a major advantage for users having widely varying production needs. With a replaceable roll pedestal 100, the user can buy one machine and modify it to run different speeds with different rolls.

Splice Traverse Mechanism

Occasionally, the strip 22 in a large coil runs out. When this occurs, the trailing edge of the first strip is spliced to a leading edge of a strip of a second coil. As the seam created by welding or mechanical attachment between the two strips passes through the coating apparatus 20, the soft applicator roll 30 must be retracted so that the rough seam does not cause damage thereto. The traverse mechanism 58 is provided to pull the coating head away from the strip when a seam is encountered.

FIG. 1 illustrates a novel traverse mechanism 58 for displacing the large traverse sled 44 along the upper inclined surface 47 of the subframe 46. A proximate end of a drive piston/cylinder 60 is pivotably mounted to a pivot bracket 61 fixedly attached to the subframe 46. The distal end 62 of the piston/cylinder 60 pivotably mounts to a pin 64 on a generally triangular shaped eccentric member 66. The eccentric member 66 is keyed for rotation with a shaft 68 journaled with respect to the subframe 46. The member 66 includes a second pin 70 to which a first end of a linkage arm 72 is rotatably journaled. A second end of the linkage arm 72 is rotatably journaled about a pin 74 forming part of a bracket 76 attached to the large traverse sled 44. In the position shown, the distal end 62 of the piston/cylinder 60 is retracted, with the eccentric member 66 in its farthest counter-clockwise orientation. In this position, the applicator roll 30 contacts the moving strip 22 to apply a coating thereto. This is termed the "head closed position."

As the distal end 62 extends toward the backing roll to the left, as shown in FIG. 1, the eccentric member 66 rotates in a clockwise direction. This causes the second pivot pin 70 to rotate with the shaft 68 in a clockwise direction. The rotation of the first end of the linkage arm 72 along with the second pivot pin 70 causes the second end of the linkage arm to translate to the right. In conjunction with this motion, the L-shaped sled 44 is translated to the right and downward along the second rail 54. This is termed the "head open position." Thus, the distal end 62 of the piston/cylinder 60 causes the traverse sled 44, and all three rolls 30, 34, and 36 mounted thereon, to translate toward or away from the backup roll 28.

The splice traverse mechanism 58 is designed so as to reduce the damage caused to the coating head rolls 30, 34 and 36 due to excessive impacts. More particularly, prior art coating systems utilize a piston cylinder movement mechanism, or other such actuator, that moves the coating head back and forth from the backup roll 28 at a constant travel speed, and rigid stops mounted to the fixed frame for limiting the coating head travel. At one end of travel, the sudden impact of the stops often damages the sliding parts, and at the other end of travel, the soft applicator roll is often damaged through impact with the hard backup roll. Another prior art mechanism involves a complex cam system for moving the coating head back and forth at varying rates.

The present invention, on the other hand, provides for a slower rate of travel of the coating head close to the backup roll 28. More particularly, with reference to FIG. 1, extension of the distal end 62 of the cylinder 60 results in counter-clockwise rotation of the eccentric member 66. This rotation, in turn, results in the clockwise rotation of the second pin 70 coupled to the eccentric member 66. The second pin 70 is initially disposed in a 9 o'clock position, as illustrated in FIG. 1, so that rotation of the eccentric member 66 results in a substantially vertical motion of the pin. As the distal end 62 extends further, the pin 70 travels toward the top of the shaft 68 until its movement includes a substantial horizontal component. The horizontal movement of the pin 70 is directly responsible for the horizontal movement of the linkage arm 72 and attached bracket 76. Thus, at the beginning of the stroke of the distal end 62, the coating head does not appreciably move in a horizontal direction. As the distal end 62 extends further, however, the movement of the coating head accelerates. Conversely, as the distal end 62 is retracted into the cylinder 60, the coating head quickly advances toward the backup roll 28. As the distal end 62 approaches its farthest retracted position, the second pin 70 approaches a point on the arc of its rotation at which there is relatively little horizontal movement. Thus, the applicator roll 30 rapidly approaches the backup roll 28 until the two rolls come close together, at which point the applicator roll decelerates and gently contacts the strip 22 or backup roll 28 without the use of stops. The reduction in impact force from this traverse arrangement greatly extends the life of the applicator roll 30 and associated components, and is less complex than prior cam mechanisms.

Roll Displacement Mechanism

Now with reference to FIG. 1–4, an improved assembly for translating each of the rolls 30, 34 and 36 along the first rail 50 independently of each other will be described. Each of the support sleds 42*a,b,c* comprises a solid, generally rectangular housing 78, to the underside of which the linear bearings 48 are attached. A cover 80 is bolted to the housing and extends laterally outward therefrom. A stepper motor 82 is enclosed by the cover 80. Preferably, a combined encoder/stepper motor 82 is utilized to enable monitoring of the relative sled positions.

Figures 2, 3:
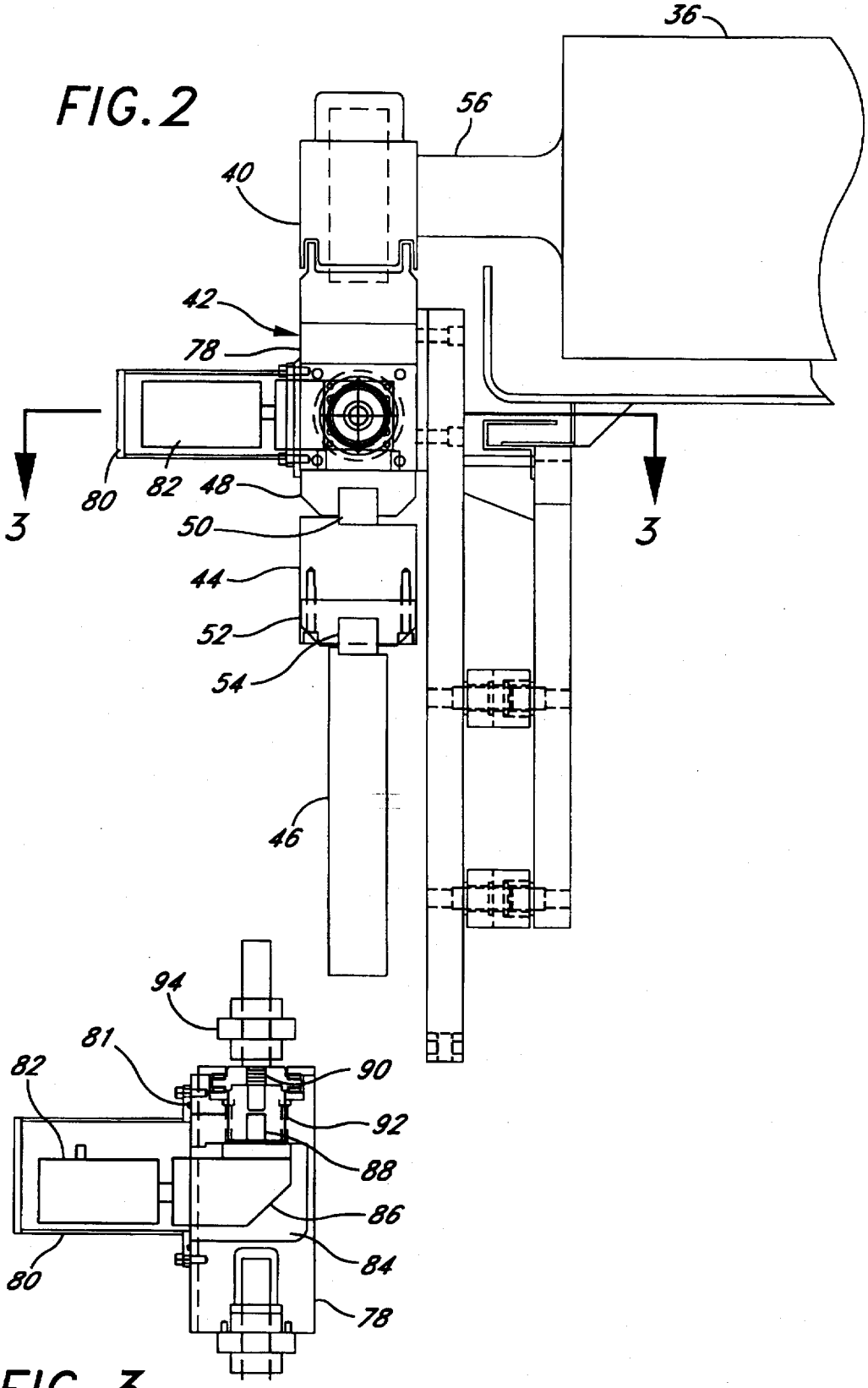
FIG. 2 is a partial front elevational view of a pickup roll within a coating pan.
FIG. 3 is a horizontal cross-sectional view through a support slide of FIG. 1.

As seen best in FIGS. 3 and 4, the rectangular housing 78 comprises a generally solid member having hollowed portions therein. A central hollow portion 84 encloses a gear box 86, the input of which is keyed to the output of the stepper motor 82. The gear box 86 encloses bevel gears journaled for rotation therein for redirecting the rotational output of the stepper motor 82 by 90°. An output shaft 88 of the gear box 86 causes a threaded rod 90 to rotate by virtue of a common dual female end coupling 92. Each threaded rod 90 extends within a linear ball screw 94 having mating internal threads. The linear ball screw associated with each support sled 42*a,b,c* is mounted on an adjacent structural member disposed up the slope of the rail 50. More specifically, as seen in FIG. 4, the linear ball screw 94*a* associated with the drive mechanism for the support sled 42*a* for the applicator roll 30 is mounted to an upstanding portion 96 of the L-shaped sled 44. Thus, rotation of the threaded rod 90 of the drive mechanism within the first support sled 42*a* causes the applicator roll 30 to translate along the first rail 50 with respect to the traverse sled 44.

In a similar manner, the linear ball screw 94*b* associated with the drive mechanism within the support sled 42*b* for the intermediate roll 34 is mounted on the applicator roll support sled 42*a*. Thus, the intermediate roll 34 can be translated with respect to the applicator roll 30. In a like manner, the linear ball screw 94*c* is mounted to the intermediate roll support sled 42*b*. Thus, the pickup roll 36 may be translated along the first rail 50 with respect to the intermediate roll 34. A series of relief cavities 98 are provided in each of the structural elements within which the threaded rods 90 translate.

As mentioned previously, the size of the roll support sleds is greatly reduced from previous designs. This necessitates a reduction in the physical size of the precision stepper motors 82. Preferably, the motors 82 have a NEMA 23 classification which lowers their cost from previous designs. Advantageously, the reduction in motor size means a concurrent decrease in power required, which lowers the chances of a spark from the motors igniting flammable solvent fumes. Furthermore, the motors 82 are fully enclosed by the covers 80 to substantially reduce the potential for an unwanted conflagration. An O-ring seal 81 is provided around the lateral opening into the hollow portion 84 for this purpose. By enclosing the motors 82 thus, motors not rated for use in explosive environments may be used, considerably reducing the expense of the whole system. Desirably, the motor 82 is sealed within an explosion-proof environment as defined by the National Electric Code Requirements, Class 1, Division 1, Group 2.

Measurement of Roll Forces

The present apparatus provides an improved means for measuring the forces between each of the rolls 30, 34 and 36. With reference to the enlarged view of FIG. 4, each of the support sleds 42*a,b,c* includes the generally rectangular housing portion 78 and upstanding vertical roll pedestal 100 to which the mounting brackets 40 are attached. The attachment means between the mounting brackets 40 and roll pedestal 100 includes aligned apertures 102 and a fastening bolt (not shown) insertable therein. The vertical roll pedestal 100 thus transmits the entire load from each of the rolls to the rectangular housing 78. Within the roll pedestal 100, a multi-axis force sensor 104 is provided. The multi-axis force sensor 104 senses forces and moments generated within the roll pedestal 100. For example, the sensor 104 monitors roll forces in the X direction between the strip 22 braced by the backup roll 28 and applicator roll 30. The force can be measured as torque, or bending moment, as the desired line of force extends through the roll axis preventing a direct in-line measurement. The measured quantity can be converted into the correct nip pressure at the point of coating application with knowledge of such other parameters as roll diameter and hardness, for instance. The multi-axis force sensor 104 may comprise strain gages, torsion sensors, or any other suitable types of sensors known to those in the art. By providing the sensors 104 between the rolls and the support sleds, any hysteresis in the bearings, or measurement error from bearing contamination is bypassed.

In a particularly desirable configuration, the multi-axis sensor 104 desirably comprises a plurality of individual strain gauges affixed at specific locations and orientations on or within cavities formed in the pedestal 100. By conforming the placement of the strain gauges to the particular shape of the pedestal 100, separately housed sensor devices are eliminated which allows the size of the pedestal to remain relatively small. In other words, there is no need to provide space and fastening flange and bolts for a bulky off-the-shelf sensor housing. Instead the individual strain gauges are custom fitted to the pedestal 100. Such strain gauges are available from a variety of force sensor manufacturers, such as Cooper Instruments of Warrenton, Va., or Omega Engineering of Stamford, Conn.

In conjunction with the discussion above with respect to the cross-sectional size of the pedestal 100, the particular sensor vendor may choose one shape of the pedestal as being more suitable than others for placing the strain gauges. Given the particular shape, a finite element analysis may be conducted based on varying rolls and coating systems to determine the cross-sectional shape of the pedestal. In most cases, the total height of the pedestal 100 is between approximately 2.0–2.5 inches, and the maximum height of the pedestal 100 is desirably less than 4 inches. This shorter pedestal 100 height is made possible by the use of a multi-axis sensor 104 defining an envelope with a height of less than 4 inches, and preferably less than 2.5 inches.

One particular advantage of the smaller pedestal height is the ability to retrofit a new coating head to an existing coating frame. Many old coating heads utilized stacked dovetail slides which are shorter in height than stacked slides with linear bearing and rails. To replace the dovetail slides with stacked slides riding on linear bearings and rails, the total height of the assembly becomes so great that it is impossible to place a conventional force sensor, with a housing of between 5 and 7 inches in height, between the slide and rolls, because of the fixed roll height with respect to the frame. With the present invention, on the other hand, pedestals of less than 4 inches, and preferably between 2.0–2.5 inches are contemplated. By using such a small sensor 104 and pedestal 100, older dovetail-type frames may be reused when updating the coating head.

As sensors 104 are provided for each roll pedestal 100, the forces between each pair of rolls 30, 34 and 36 and between the applicator roll 30 and backup roll 28 can be determined. More particularly, the sensor 104 positioned within the roll pedestal 100 of the third support sled 42*c* senses forces between the intermediate roll 34 and pickup roll 36. The sensor 104 mounted in the roll pedestal 100 of the second support sled 42*b* senses forces between the applicator roll 30 and intermediate roll 34, and between the intermediate roll 34 and pickup roll 36. Combining information gathered from the sensors 104 in the second and third support sleds 42*b,c*, the absolute forces between the applicator roll 30 and intermediate roll 34 can be determined. In a like manner, the output from the sensor 104 within the first support sled 42*a* provides information about forces between the backup roll 28 and applicator roll 30, and between the applicator roll 30 and intermediate roll 34. Again, by a simple subtraction of force components, the absolute component of force between the backup roll 28 and applicator roll 30 can be solved for. In conjunction with the sensing of the forces between the rolls, conventional angular position monitoring devices (not shown) associated with each of the stepper motors 82 convey the exact position of the respective support sleds 42*a,b,c*. Thus, accurate knowledge of the position of the rolls and forces between the rolls are supplied to an operator or automated processor for controlling the quantity and quality of coating applied to the strip 22.

One aspect of force measurement which is utilized to improve the performance of the coating apparatus 20 is the measurement of shear forces in the Y-axis between the applicator roll 30 and moving strip 22. The shear forces are dependent upon the nip pressure, the speed of the rolls, and the viscosity. With accurate knowledge of the nip pressure and roll speed, knowledge of the Y component of force between the roll and the strip allows one to accurately calculate the viscosity of the coating medium. By sampling the forces in the Y direction between the applicator roll 30 and strip 22, the viscosity of the coating medium can be continuously monitored and the process adjusted accordingly throughout a coating run. This is a vast improvement over delayed feedback methods of the prior art.

Of course, the viscosity depends on several other factors, which are of lessor importance. For example, in most instances it is preferable that the surface of the applicator roll 30 travel in the opposite direction as the moving strip 22 to ensure proper transfer of the coating medium from the applicator roll at the point of contact with the surface of the metal strip. In some instances, however, it is necessary to rotate the applicator roll in the same direction as the moving strip 22 to obtain a sufficiently thin film of coating medium on the strip. The relative direction of movement of the applicator roll 30 and strip 22 is a factor to be taken into account when utilizing the measured Y component of force to determine coating medium viscosity.

Another substantial benefit to the present force measurement configuration is the ability to accurately and regularly check the hardness of the cover of the applicator roll 30. To accomplish this, the roll 30 is moved and a measurement of the nip pressure in the X direction is combined with knowledge of the distance change between the axes of the applicator roll 30 and the backup roll 28. The position of the force sensor 104 between the roll 30 and the associated linear bearings greatly increases the reliability of the force measured over prior methods. As a coating run progresses, the changing hardness of the roll cover is thus reliably monitored for input into a control algorithm.

Coating Pan Lift Mechanism

Figure 5:
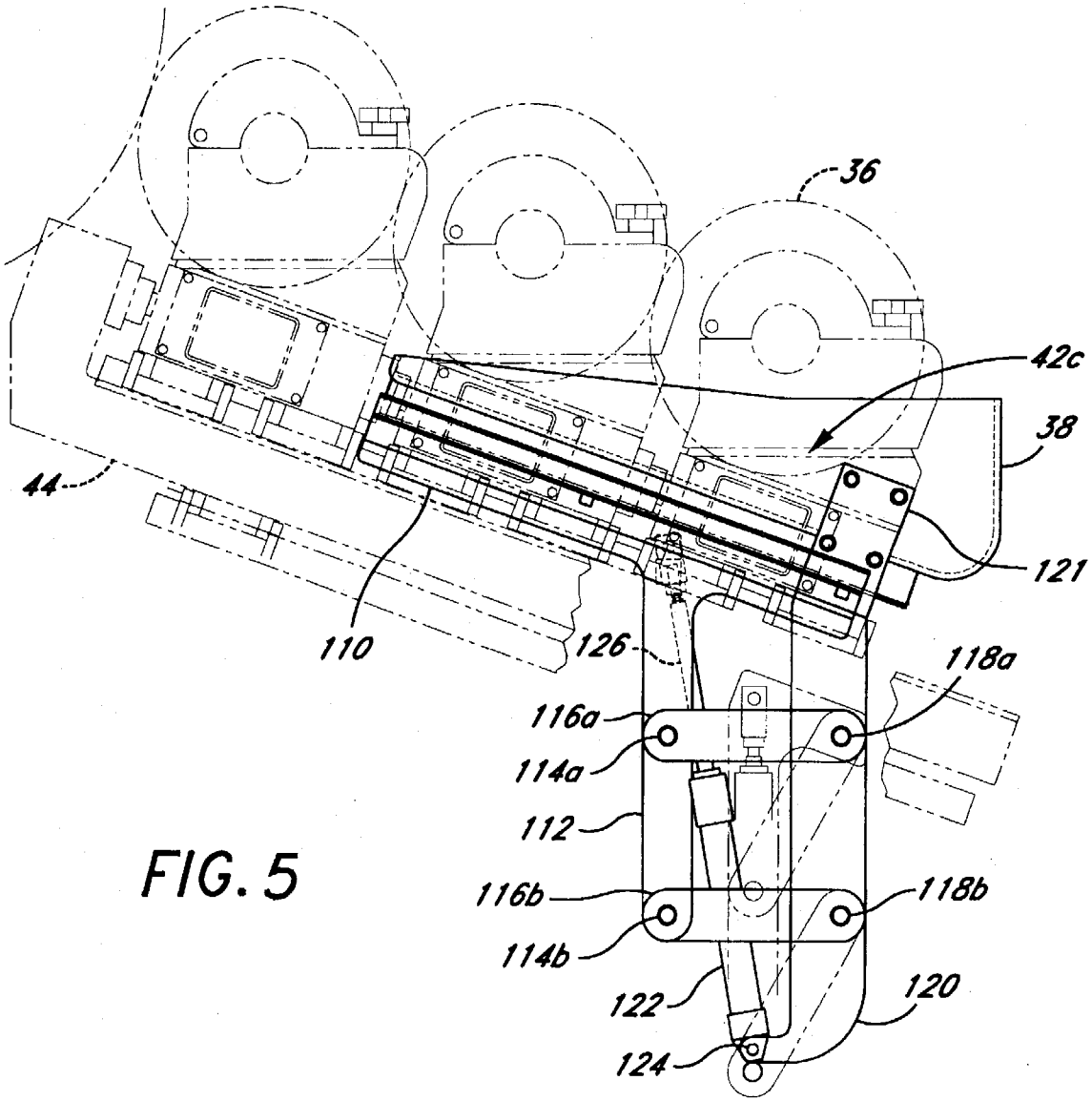
FIG. 5 shows a pan lift mechanism of the device of FIG. 1.

Now with reference to FIG. 5, the improved mechanism 39 for displacing the coating pan 38 is described. The coating pan 38 is supported by a pan lift bracket 110. The pan lift bracket includes a downwardly depending leg 112 having a pair of pivot pins 114*a,b*. A pair of linkage arms 116*a*, 116*b* are journaled at one end to the pivot pins 114*a,b* and at the other end to a pair of pivot pins 118*a*, 118*b* fixed with respect to a generally vertically disposed moving bracket 120. The moving bracket 120 rigidly attaches to an inner surface of the third support sled 42*c* at mounting plate 121. In prior devices, the coating pan 38 was not coupled to the movement of the pickup roll 36, and thus there was a danger of the roll neck 56 contacting the coating pan. In the preferred embodiment, on the other hand, as the pickup roll 36 is translated downward along the first rail 50, the moving bracket 120 translates with it. Thus, the entire linkage of the pan lift mechanism 108 translates with the pickup roll 36. Again, by design, the maximum height of the coating pan 38 is set so that the upper edge of the pan cannot contact the roll neck 56.

A piston/cylinder 122 is pivotably attached at a first end 124 to a lower portion of the moving bracket 120. A distal end 126 of the piston/cylinder 122 is pivoted to swivel around a shoulder bolt which is rigidly mounted with respect to the coating pan bracket 110. Although a piston/cylinder is the preferred embodiment, other means for raising and lowering the coating pan, such as manual hand wheels or stepper motors, may be substituted. Extension and retraction of the distal end 126 of the piston/cylinder 122 causes the coating pan 38 to be raised or lowered. More specifically, the pan lift mechanism shown in solid line in FIG. 5 is in a position wherein the coating pan 38 is raised so that the pickup roll 36 is immersed in the coating medium in the pan. In this position, the distal end 126 of the piston/cylinder 122 is fully extended. The retracted position of the mechanism is shown in phantom. Specifically, in the retracted position, the distal end 126 has been retracted causing the coating pan bracket 120 to lower, thus removing the pickup roll 36 from immersion in the coating medium. By virtue of the pivoting mount of the piston cylinder 122 to the moving bracket 120, the coating pan 138 not only lowers but pivots slightly away from the backup roll 28. This enables the interior of the coating pan 38 to be easily accessed for cleaning, or re-filling with coating medium.

FIG. 2 shows the upper edge of the coating pan 38 adjacent the roll neck 56. Previously, despite safety warnings, there was no way to avoid the risk of fire due to operator error. Specifically, if the operator permitted the coating pan 38 to contact the roll neck 56, this contact could create a spark which could ignite the volatile fumes constantly evaporating from the coating medium. In the preferred embodiment, this risk is virtually eliminated by mounting the lift mechanism 39 to provide displacement of the coating pan 38 with respect to the third support sled 42*c*, rather than with respect to the fixed subframe 46. In other words, since the moving bracket 120 translates with the third support sled 42*c*, its position with respect to the roll neck 56 of the pickup roll 36 does not change. Thus, the extension of the distal end 126 of the piston/cylinder 122 is, at all times, relative to the lower end of the moving bracket 120, and the full extension of the distal end 126 can be set below that which the edge of the coating pan 38 contacts the roll neck 56 of the pickup roll 36. On occasion, the size of the rolls 30, 34 and 36 may be modified, or the coating head converted from 2 to 3 rolls, in which case the roll neck 56 of the pickup roll 36 may be displaced downward. The present invention thus provides a fail safe arrangement to preclude lift mechanism-to-coating pan contact.

Single Rail Coating Apparatus

Figure 6A:
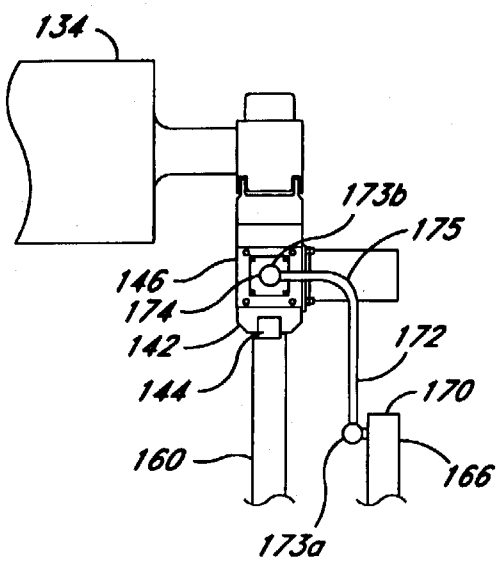
FIG. 6*a* is a front elevational view of a short traverse sled and pivotably attached bent linkage arm taken along line 6*a*—6*a* of FIG. 6.
Figure 6:
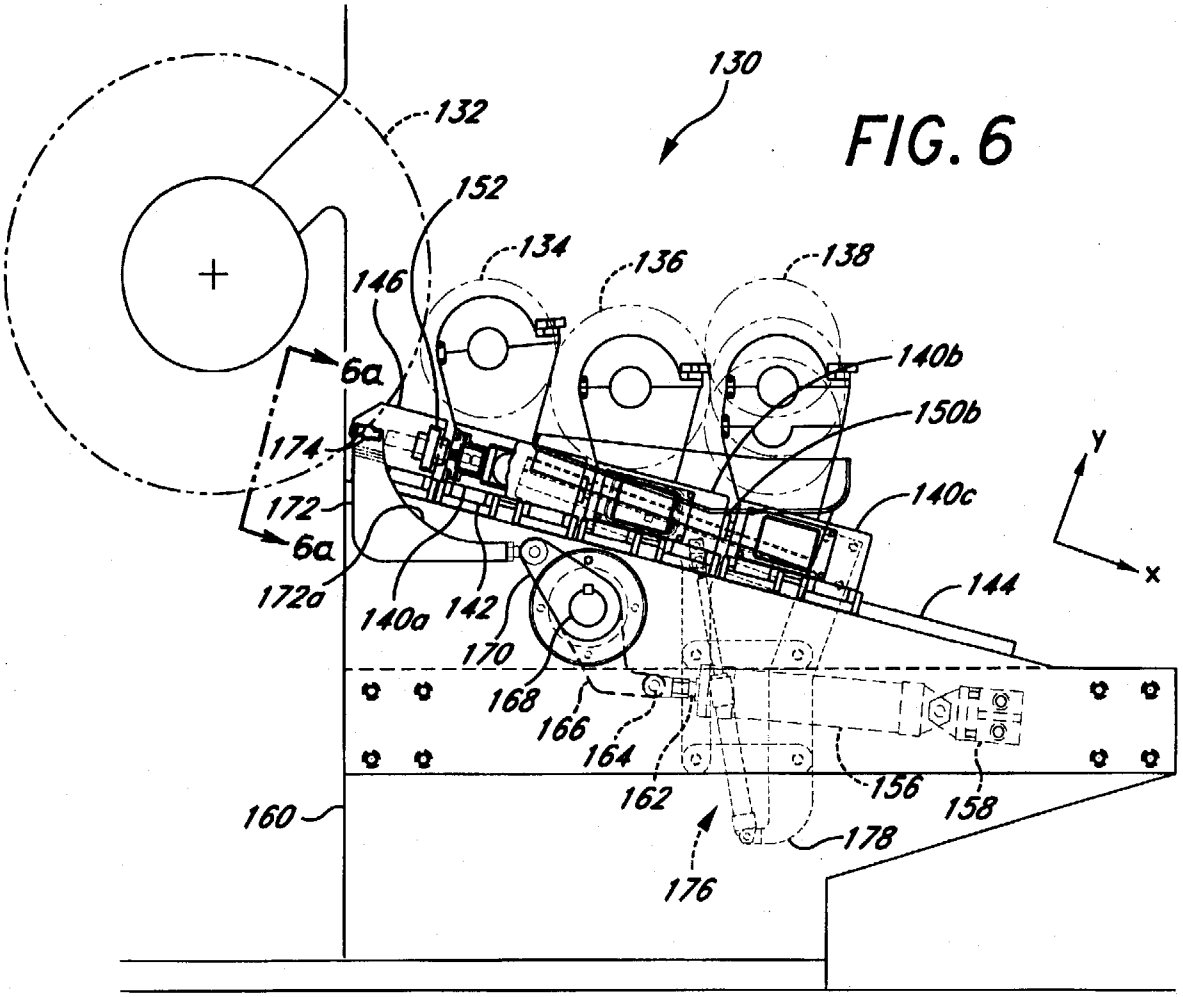
FIG. 6 is a side elevational view of an alternative embodiment of the coating machine of the present invention incorporating a single rail on which the three rolls and an extra slide are slidably mounted.

Now with reference to FIG. 6, an apparatus 130 for coating strip 131 is shown which is similar to the coating apparatus 20 of FIG. 1, but which eliminates the large traverse sled 44. The apparatus 130 comprises a backup roll 132, and a displaceable coating head including an applicator roll 134, an intermediate roll 136, and a pickup roll 138. The rolls 134, 136 and 138 are similar in most respects to the rolls 30, 34, and 36 described previously, with the exception that the intermediate roll 136 has a larger diameter than the adjacent two rolls. Like the apparatus 20, the axes of the rolls are located along the line which passes through the center of the backup roll 132. The pickup roll 138 may be raised as indicated by the upper dashed line positions for different coating mediums which may require the intermediate roll 136 to be immersed in the coating pan and function as the pickup roll.

Each of the rolls 134, 136 and 138 are mounted for rotation on support sleds 140*a*, 140*b* and 140*c*, respectively. A plurality of linear bearings 142 attached to the support sleds 140 provide relatively frictionless sliding movement over a sloped rail 144. In place of the large L-shaped traverse sled 44 of FIG. 1, a short traverse sled 146 is provided uphill from the first support sled 140*a* on the rail 144. The traverse sled 146 has a linear bearing 148 adapted to slide along the rail 144. Each of the support sleds 140*a,b,c* are similar to the support sleds 42 previously described with reference to the embodiment of FIG. 1. That is, each of the support sleds includes a stepper motor, a gear box and a threaded rod adapted for mating with a linear ball screw mounted to an adjacent structural element located uphill along the rail 144. Thus, the first and second support sleds 140*a,b* include linear ball screws 150*a,b*. A third linear ball screw 152 is mounted to one end of the traverse sled 146. The threaded rod of the first support sled 140*a* extends within the ball screw 152 to affect relative movement between the first support sled 140*a* and the traverse sled 146.

The entire assembly of three rolls 134, 136 and 138 can be translated forward or backward along the rail 144 by virtue of a modified traverse mechanism 154. As before, a piston/cylinder 156 is pivotably mounted to a pivot bracket 158 affixed to the subframe 160 of the apparatus 130. The distal end 162 of the piston/cylinder 156 is pivotably mounted to a first end 164 of a crank 166. The crank 166 is keyed to rotate with a shaft 168 journaled with respect to the frame 160. A second end 170 of the eccentric member 166 pivotably attaches to one end of a bent linkage member 172. The opposite end of the linkage member 172 is pivotably attached to a central point 174 on the traverse sled 146.

FIG. 6*a* illustrates the particular bent shape of the linkage member 172. The lower end preferably includes a swivel connection point 173*a* comprising a ball sized to swivel within a socket formed in the second end 170 of the eccentric member 166. The linkage member 172 extends upward in a vertical plane until approximately the height of the linear bearing 142 of the traverse sled 146, at which point the linkage member 172 turns laterally toward the traverse sled 146 at a bend 175. A second swivel connection point comprises a ball 173*b* which fits within a socket formed at the central point 174 on the traverse sled 146. The member 172 is bent in this manner, and the second ball 173*b* connected at the central point 174 directly over the rail 144, so as to avoid imposing moments on the traverse sled 146. The ball and socket couplings at either end of the linkage member 172 provide rotational freedom about more than one axis to prevent binding as the odd-shaped linkage member transmits forces and motions between the traverse sled 146 and eccentric member 166. Of course, other coupling configurations providing more than one axis of rotation are contemplated. Additionally, looking at the side view of FIG. 6, an arcuate upper edge 172*a* of the linkage member 172 provides a structural relief precluding contact between the linkage member and the laterally extending stepper motor cover associated with the first support sled 140*a*.

The modified traverse mechanism 154, as with the previously described traverse mechanism 58, permits very repeatable repositioning, yet creates a leverage geometry that theoretically may cause an intense multiplication of input force from the piston/cylinder 156. Indeed, improper adjustment of the position of the applicator roll 30 by an operator can cause a significant interference between the applicator and backup rolls upon traversing the applicator roll into the coating position. Desirably, the first swivel connection point 173*a* (FIG. 6*a*) is designed to break loose at a predefined load to prevent equipment damage. The connection is also designed to be captured and permit enough movement to relieve the load without allowing a large unexpected recoil which might result in injury.

In the position shown in FIG. 6, the distal end 162 of the piston/cylinder 156 is in a retracted position wherein the crank 166 is rotated as far as it will go in the counterclockwise direction. Extension of the distal end 162 causes the crank 166 to rotate clockwise about the axis of the shaft 168. The second end 170 of the crank 166 thus rotates clockwise causing the bent linkage member 172 to translate away from the backup roll 132. Thus, the entire assembly of the traverse sled 146, and three support sleds 140*a,b,c* are caused to translate in the X direction along the rail 144 away from the backup roll 132. Again, when a splice in the strip 131 is encountered by the apparatus 130, the coating head must be retracted from contact with the strip or damage is caused to the deformable cover on the applicator roll 134.

Figure 7:
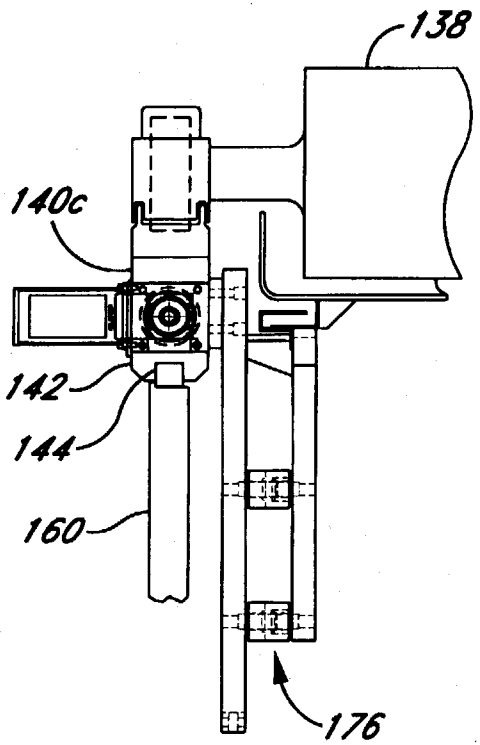
FIG. 7 is a front elevational view of a pickup roll and coating pan of FIG. 6.

FIG. 7 illustrates the vertical arrangement of the sleds 140 with respect to the single rail 144. In contrast to the embodiment shown in FIG. 2, the single rail 144 mounted on the subframe 160 guides both the roll support sleds 140*a,b,c* and traverse sled 146. This substantial reduction in machined parts results in a large cost saving to the overall machine.

Figure 8:
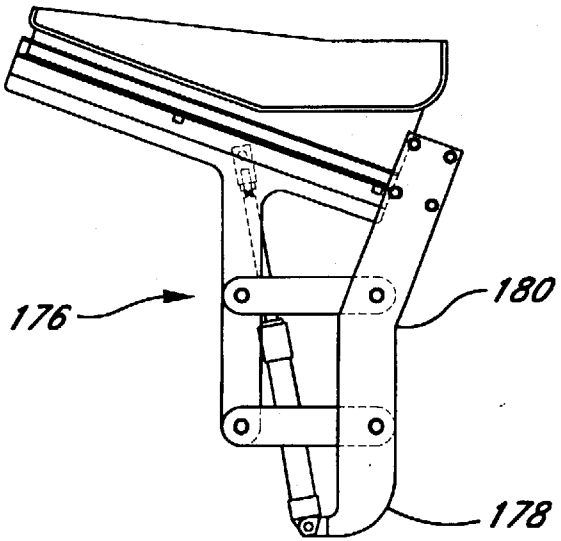
FIG. 8 shows a pan lift mechanism of the device of FIG. 6.

FIG. 8 shows a slightly modified version of a pan lifting mechanism 176. In this embodiment, the moving bracket 178 is angled slightly to extend downward from the third support sled 140*c* in a direction perpendicular to the rail 144 until an elbow bend 180 approximately midway along its length, whereupon the bracket extends vertically downward. The operation of the mechanism 176 is as described previously with respect to the lift mechanism 39 of FIG. 1.

Double-Sided Coating Apparatus

Figure 9:
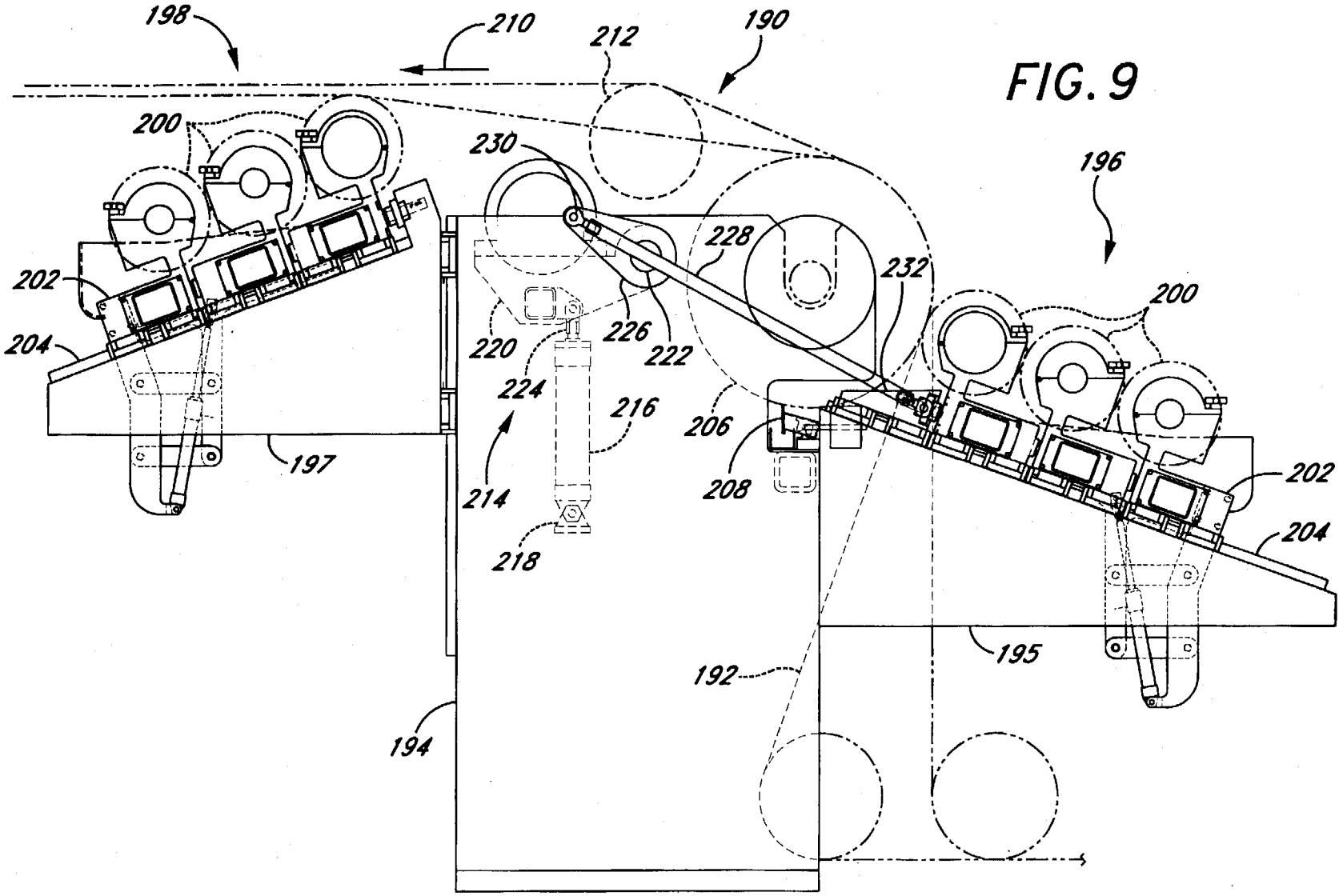
FIG. 9 is a side elevational view of a further embodiment of a coating machine of the present invention in which the movement of a lift roll in a double coating environment is coupled to movement of the three applicator rolls of a first coating head.

FIG. 9 illustrates a system 190 for coating both sides of a strip 192 of metal. The system generally comprises a frame 194 having a first coating assembly 196 attached to a first subframe 195 for coating one side of the strip 192, and a second coating assembly 198 attached to a second subframe 197 for coating the opposite side of the strip. Both the first coating assembly 196 and second coating assembly 198 are substantially similar to the coating apparatus 130 shown and described with reference to FIGS. 6–8. That is, the coating assemblies 196, 198 each comprise coating heads including three aligned rolls 200 mounted on support sleds 202 arranged to sled on rails 204.

The strip 192 passes between the first coating assembly 196 which coats one side of the strip 192, and a backup roll 206. A doctor blade 208 is positioned to scrape excess paint from the lower portion of the backup roll 206. The strip 192 continues left in the direction of arrow 210 over the applicator roll of the second coating assembly 198 which coats the opposite side of the strip 192. In this manner, both sides of the strip 192 are coated.

On occasion, it is necessary for the terminal end of the strip to be spliced with the leading end of a second strip so as to maintain the continuity of the coating process. As described above, the welded or mechanically joined splice is relatively rough and may damage the applicator rolls of the coating assemblies 196, 198. When the splice seam is passing through the system 190, the first coating assembly 196 is retracted from the backup roll 206 to prevent the strip from contacting the applicator roll of the first coating assembly 196 and a lift roll 212 is raised to lift the strip 192 from contacting the applicator roll of the second coating assembly 198. Thus, when the strip 192 is being coated, the lift roll 212 assumes the solid line position shown in FIG. 9, and when a rough splice passes through the system 190, the lift roll 212 assumes the position shown in phantom.

An important aspect of the present invention is the coupling of the mechanism 214 for raising and lowering the lift roll 212 to the traverse mechanism for the first coating assembly 196. In this way, both the lift roll 212 and the coating head of the first coating assembly 196 may be actuated simultaneously when a splice seam passes through the system 190.

The mechanism 214 comprises a piston/cylinder 216 pivotably mounted at a lower end to a pivot bracket 218 secured to and pivotably mounted at an upper end to a lift roll support 220. The lift roll support 220 comprises a rigid member capable of supporting the lift roll 212 for rotation, and is pivotably mounted with respect to the frame 194 on a shaft 222. Raising and lowering of the actuating end 224 of the piston/cylinder 216 causes the lift roll support 220 to rotate with the shaft 222. In this manner, the lift roll 212 can be displaced from the lower solid line position to the upper dashed line position of FIG. 9.

An eccentric member 226 is keyed or otherwise rotatably secured to the shaft 222. A linkage bar 228 pivotably mounts to an outer extension 230 of the eccentric member 226. The opposite end of the linkage arm 228 is pivotably attached to a short traverse sled 232 arranged to slide on the rail 204 and comprising a portion of the first coating assembly 196. The traverse sled 232 is analogous to the traverse sled 146 described above with reference to FIG. 6. Thus, as the eccentric member 226 is rotated about the axis of the shaft 222, the linkage arm 228, by virtue of its pivoting connection to the extending portion 230 of the eccentric member, displaces the traverse sled 232, and coating head of the first coating assembly 196, downward along the rail 204 away from the backup roll 206. This displacement is linked to simultaneous elevation of the lift roll 212 which lifts the strip 192 out of contact with the second coating assembly 198. Linking the movement of these two components simplifies the operational steps taken when a splice passes through the system.

The combination of the lift roll 212 and second coating assembly 198 provides both a coarse and fine adjustment of the wrap angle of the strip 192 around the applicator roll 200 of the second coating assembly. More particularly, the lift roll 212 may be positioned at two or more discrete elevations to coarsely set the wrap angle around the applicator roll 200. Then, if the wrap angle must be finely adjusted, the coating head of the second coating assembly 198 may be displaced along the rail 204. The precise movement provided by the stepper motors, threaded rods and linear ball screws allows for practically infinite adjustment of the wrap angle around the applicator role of the second coating assembly 196.

U-Wrap Coating Apparatus

Figure 10A:
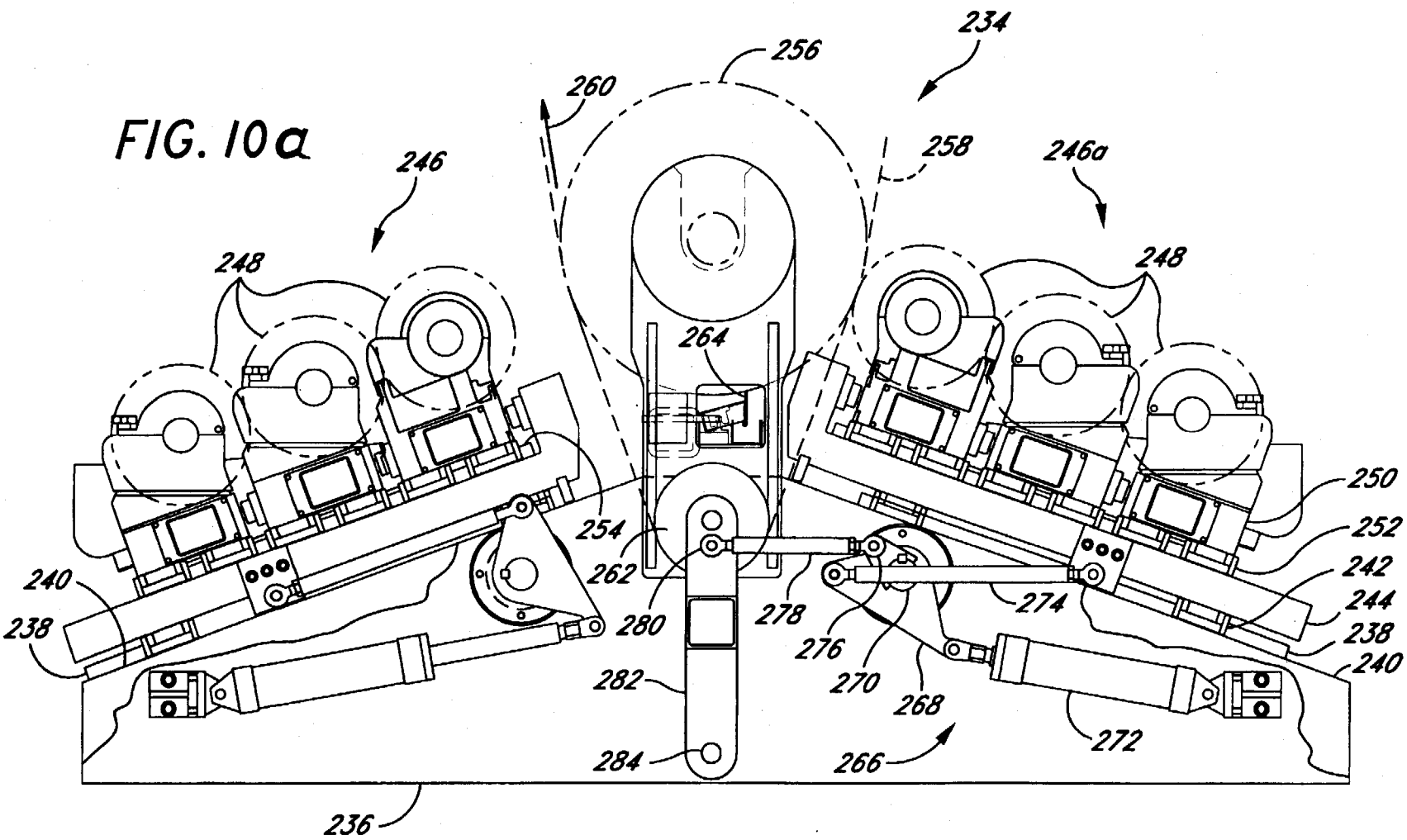
FIG. 10*a* is a U-wrap coating machine of the present invention utilizing one of two coating heads at a time on either side of a backup roll for coating one side of a moving strip, the illustration showing an upstream coating head in operation.

FIGS. 10*a* and lob illustrate a further embodiment of a U-wrap coating system 234 incorporating the inventive aspects herein. U-wrap coaters are special one-side coaters which enable coating with one of two coating heads. Switching from one coating head to another may be desired to change the coating medium, for example.

The system 234 comprises a lower frame assembly 236 having rails 238 mounted on upper angled surfaces 240. The rails 238 provide a guide for linear bearings 242 of L-shaped sled members 244 of first and second coating assemblies 246*a*, 246*b*. The coating assemblies 246*a,b* are substantially similar to the apparatus 20 described with reference to FIGS. 1–5. In particular, both of the coating assemblies 246*a,b* include a coating head having a plurality of aligned rolls 248 mounted on support sleds 250 having linear bearings 252 for sliding on a rail 254 provided on the L-shaped sled member 244. Both applicator rolls 248*a* are positioned adjacent a central backup roll 256. The strip 258 travels between the backup roll 256 and the coating head of the upstream coating assembly 246*a*, clockwise around a lower movable bypass or turn roll 262, and between the backup roll 256 and the coating head of the downstream coating assembly 246*b* in the direction of arrow 260. The lower turn roll 262 extends in the Z-direction at least the width of the roll and is journaled for rotation about an upper portion of a pair of swing arms 282, one of which is visible.

Only one of the assemblies 246*a* or 246*b* applies coating to the strip 258 at any one time. When the first assembly 246*a* is in contact with the strip 258, the second assembly 246*b* is retracted out of contact therewith. The mechanisms for retracting and advancing the assemblies 246*a,b* are described below. A doctor blade 264 is mounted to the frame assembly 236 for scraping excess coating medium off the lower portion of the backup roll 256 for reasons discussed above. The doctor blade 264 is mounted directly underneath the backup roll 256 in a space between two large supporting brackets (not numbered).

Both the first and second coating assemblies 246*a,b* incorporate traverse mechanisms 266 similar to the traverse mechanism 58 shown in FIG. 1. More particularly, each of the traverse mechanisms includes a crank 268 mounted to a shaft 270, the crank being rotated by a piston cylinder 272. A linkage arm 274 couples the rotation of the crank 268 with the linear movement of the L-shaped sled members 244 along the rails 238.

As mentioned above, only one of the coating assemblies 246*a,b* is utilized for coating the strip 258 at any one time. As seen in FIG. 10*a*, when the upstream coating assembly 246*a* is coating the strip 258, the excess paint left on the backup roll 256 is scraped off by the doctor blade 264 underneath the backup roll. Thus, the strip 258 can pass around the turn roll 262 and contact the backup roll 256 in the direction of a curing oven. No excess coating medium will be applied to the reverse side of the strip 258 by the backup roll 256.

Figure 10B:
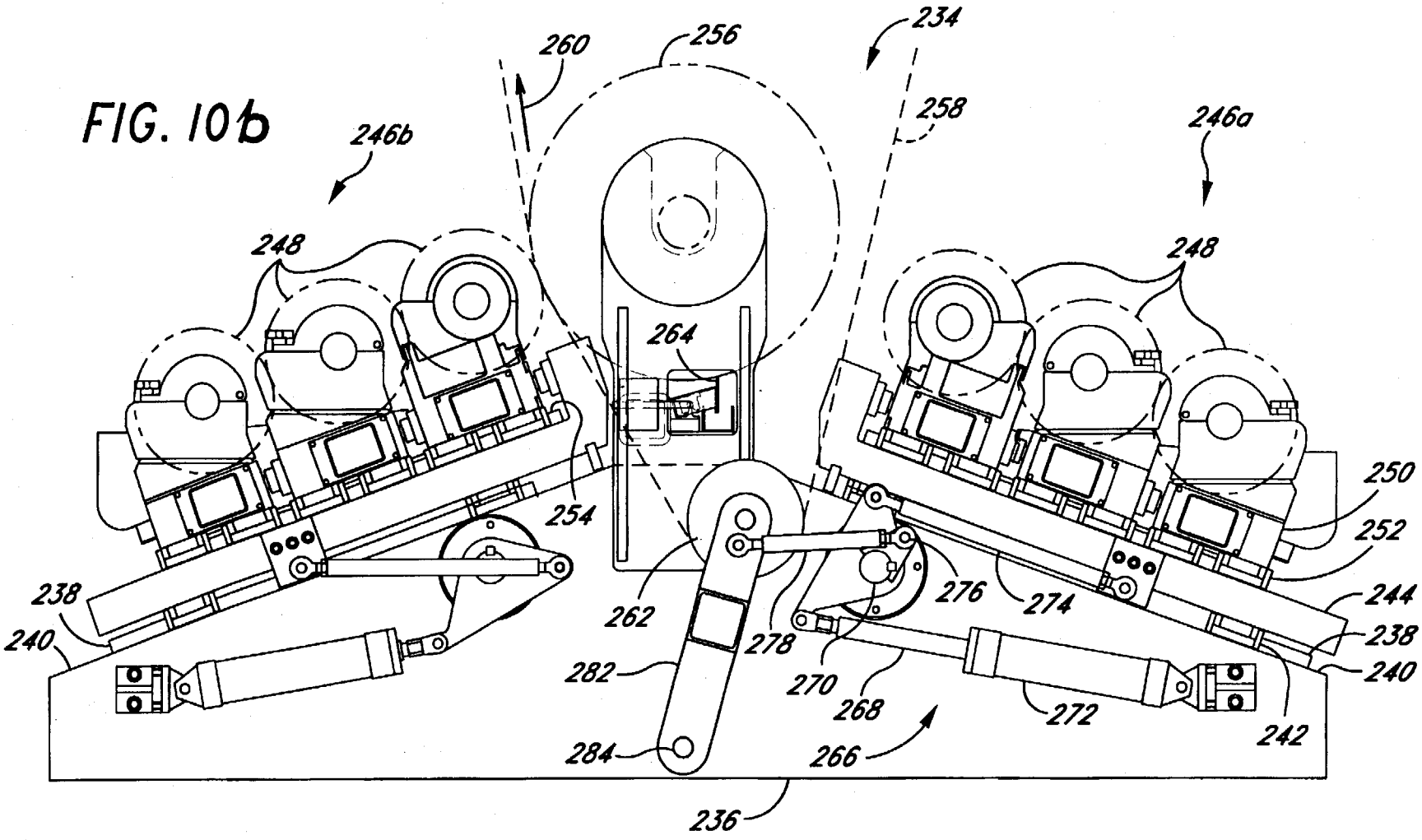
FIG. 10*b* is the U-wrap coating machine of FIG. 10*a* showing a downstream coating head in operation.
Figures 11, 11A:
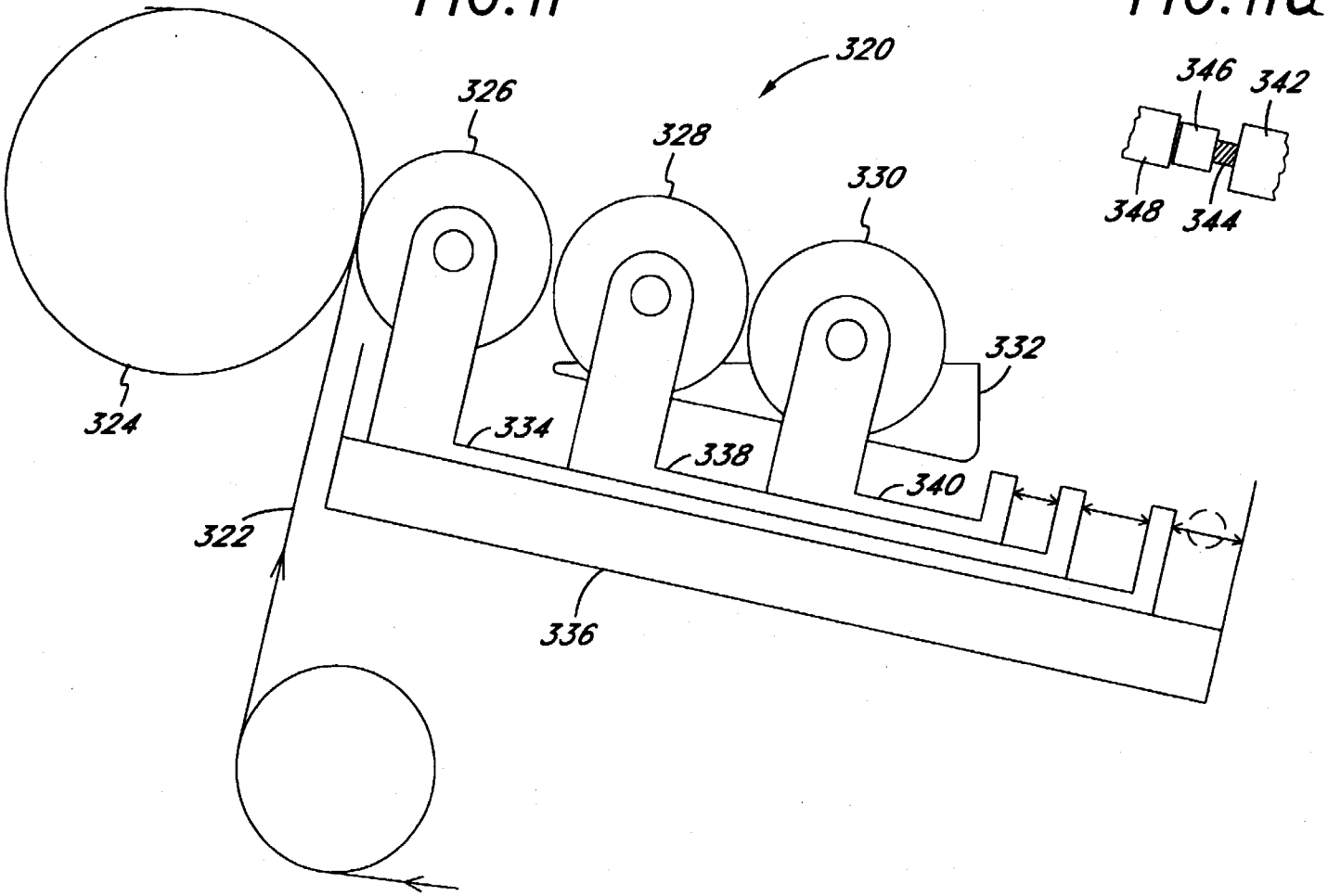
FIG. 11 is a schematic elevational view of a prior art coating mechanism.
FIG. 11*a* is an enlarged view of a linear actuator of the prior art coating mechanism of FIG. 11.

On the other hand, when the downstream coating assembly 246b is in operation, the excess coating medium on the backup roll 256 passes around the top of the roll and will contact the strip 258 on the opposite side of the roll prior to reaching the doctor blade 264 at the lower portion. In this situation, the strip 258 must be retracted from contact with the backup roll 256. This is accomplished by linking the displacement of the bypass or turn roll 262 with the displacement of the sled member 244 of the upstream coating assembly 246a. More particularly, for the upstream coating assembly 246a, an eccentric member 276 is keyed to the shaft 270 and has a linkage bar 278 pivotably attached to an outer extension. An opposite end 280 of the linkage bar 278 is pivotably attached to the swing arms 282 which rotate about a shaft 284. Clockwise rotation of the second eccentric member 276 upon extension of the actuator of the piston/cylinder 272 causes the linkage bar 278 to be displaced to the right, thus swinging the arms 282 toward the shaft 270. This, in turn, causes the turn roll 262 to displace the strip 258 away from contact with the backup roll 256, as seen in FIG. 10b. Thus, the upstream coating assembly 246a is retracted from proximity to the backup roll 256 when the second coating assembly 246b is in operation, and the movement of the upstream coating assembly 246a is coupled to the movement of the strip 258 so that the strip "bypasses" the backup roll. Excess paint on the backup roll 256 is then allowed to travel around to be scraped off by the doctor blade 264.

Although this invention has been described in terms of certain preferred embodiments, other embodiments that are apparent to those of ordinary skill in the art are also within the scope of this invention. Accordingly, the scope of the invention is intended to be defined by the claims that follow.

What is claimed is:

1. An apparatus for applying a layer of liquid coating of controlled thickness onto the surface of a travelling web, comprising:

a frame;

a source of liquid coating material;

a first roll sled movable with respect to said frame along a line;

a first roll defining a first axis supported by said first roll sled and journaled so as to be rotatable about said first axis;

a second roll sled movable along said line;

a second roll defining a second axis supported by said second roll sled and journaled so as to be rotatable about said second axis; and a third roll sled movable along said line and a third roll defining a third axis, wherein none of said roll sleds supports another of said roll sleds.

2. The apparatus of claim 1, further comprising a first motor coupled to said second roll sled to selectively change the relative distance between said first axis and said second axis.

3. The apparatus of claim 2, wherein said first motor is mounted on one of said first roll sled and said second roll sled.

4. The apparatus of claim 2, further comprising a second motor coupled to said first sled to selectively change the distance between said first axis and an application location.

5. The apparatus of claim 4, wherein said first motor and said second motor are each mounted on a different one of said sleds.

6. The apparatus of claim 5, further comprising a coating pan supported by said frame.

7. The apparatus of claim 6, further comprising a third motor coupled to said second roll sled to selectively change the relative distance between said second axis and said third axis.

8. The apparatus of claim 7, wherein said third motor is mounted on said third roll sled.

9. The apparatus of claim 8, further comprising a traverse sled movable with respect to an application location, wherein said first sled, said second sled and said third sled are-supported by said traverse sled.

10. The apparatus of claim 9, further comprising an actuator connected to said traverse sled by a linkage which moves said support sled at a first speed when one of said rolls is in proximity to an application location and at a second,-faster speed when said one of said rolls is farther from said application location.

11. The apparatus of claim 10, wherein said first axis, said second axis and said third axis are coplanar and parallel to one another.

12. The apparatus of claim 5, further comprising a third motor coupled to said second roll sled to selectively change the relative distance between said second axis and said third axis.

13. The apparatus of claim 12, wherein said third motor is mounted on said third roll sled.

14. The apparatus of claim 13, further comprising a first multi-axis sensor mounted on said first roll sled, a second multi-axis sensor mounted on said second roll sled and a third multi-axis sensor mounted on said third roll sled.

15. The apparatus of claim 14, further comprising a traverse sled movable along a second line, wherein said first sled, said second sled and said third sled are supported by said traverse sled.

16. The apparatus of claim 15, further comprising an actuator connected to said traverse sled by a linkage which moves said support sled at a first speed when one of said rolls is in proximity to an application location and at a second, faster speed when said one of said rolls is farther from said application location.

17. The apparatus of claim 5, further comprising a first multi-axis sensor mounted on said first roll sled and a second multi-axis sensor mounted on said second roll sled.

18. The apparatus of claim 17, further comprising a traverse sled movable along a second line, wherein said first sled and said second sled are supported by said traverse sled.

19. The apparatus of claim 18, further comprising an actuator connected to said traverse sled by a linkage which moves said support sled at a first speed when one of said rolls is in proximity to an application location and at a second, faster speed when said one of said rolls is farther from said application location.

20. The apparatus of claim 1, further comprising a first multi-axis sensor mounted on said first roll sled and a second multi-axis sensor mounted on said second roll sled.

21. The apparatus of claim 20, further comprising a traverse sled movable along a second line, wherein said first sled and said second sled are supported by said traverse sled.

22. The apparatus of claim 21, further comprising an actuator connected to said traverse sled by a linkage which moves said support sled at a first speed when one of said rolls is in proximity to an application location and at a second, faster speed when said one of said rolls is farther from said application location.

23. The apparatus of claim 1, further comprising a traverse sled movable along a second line, wherein said first sled and said second sled are supported by said traverse sled.

24. The apparatus of claim 23, further comprising an actuator connected to said traverse sled by a linkage which moves said support sled at a first speed when one of said rolls is in proximity to an application location and at a second, faster speed when said one of said rolls is farther from said application location.

25. The apparatus of claim 1, wherein said line forms an angle with the horizontal, and said first roll sled is positioned along said line above said second role sled, said apparatus further including a traverse sled moveable with respect to said frame and having a portion located above said first roll sled in the direction of said line, and a first motor coupled between said traverse sled portion and said first roll sled to selectively change the relative distance between said traverse sled and said first roll sled.

26. The apparatus of claim 25, further including a second motor coupled between said first roll sled and said second roll sled to selectively change the distance between said first and second roll sleds.

27. The apparatus of claim 26, wherein said traverse sled is moveable along said line.

28. The apparatus of claim 27, further comprising an actuator connected to said traverse sled by a linkage which moves said traverse sled at a first speed when said first roll is in proximity to an application location, and at a second, faster speed when said first roll is farther from said application location.

29. The apparatus of claim 26, further including a second line fixed with respect to said frame along which said traverse sled moves, wherein said first line is mounted on said traverse sled so as to be parallel to and spaced from said second line.

30. The apparatus of claim 29, further comprising an actuator connected to said traverse sled by a linkage which moves said traverse sled at a first speed when said first roll is in proximity to an application location, and at a second, faster speed when said first roll is farther from said application location.

31. The apparatus of claim 1, further including:

a pedestal on said first roll sled which supports substantially the entire weight of said first roll, said pedestal being removable and having a cross-section selected to have a natural frequency of vibration which is out of phase with the natural frequency of vibration of the system of said first roll supported on said pedestal.

32. The apparatus of claim 31, further including:

a pedestal on said second roll sled which supports substantially the entire weight of said second roll, said pedestal being removable and having a cross-section selected to have a natural frequency of vibration which is out of phase with the natural frequency of vibration of the system of said second roll supported on said pedestal.

33. An apparatus for applying a layer of liquid coating of controlled thickness onto the surface of a travelling web, comprising:

a frame;

a source of liquid coating material;

a first roll sled movable with respect to said frame along a line;

a first roll defining a first axis supported by said first roll sled and journaled so as to be rotatable about said first axis;

a second roll sled movable along said line, wherein neither of said roll sleds are supported by the other;

a second roll defining a second axis supported by said second roll sled and journaled so as to be rotatable about said second axis; and a pedestal on said first roll sled which supports substantially the entire weight of said first roll, said pedestal being removable and having a cross-section selected to have a natural frequency of vibration which is out of phase with the natural frequency of vibration of the system of said first roll supported on said pedestal.

34. The apparatus of claim 33, further including:

a pedestal on said second roll sled which supports substantially the entire weight of said second roll, said pedestal being removable and having a cross-section selected to have a natural frequency of vibration which is out of phase with the natural frequency of vibration of the system of said second roll supported on said pedestal.

* * * * *